US008290782B2

(12) United States Patent
Shmunk

(10) Patent No.: US 8,290,782 B2
(45) Date of Patent: Oct. 16, 2012

(54) COMPRESSION OF AUDIO SCALE-FACTORS BY TWO-DIMENSIONAL TRANSFORMATION

(75) Inventor: Dmitry V. Shmunk, Novosibirsk (RU)

(73) Assignee: DTS, Inc., Calabasas, CA (US)

( * ) Notice: Subject to any disclaimer, the term of this patent is extended or adjusted under 35 U.S.C. 154(b) by 964 days.

(21) Appl. No.: 12/220,492

(22) Filed: Jul. 24, 2008

(65) Prior Publication Data

US 2010/0023336 A1 Jan. 28, 2010

(51) Int. Cl.
*G10L 19/00* (2006.01)
*G10L 19/02* (2006.01)

(52) U.S. Cl. ..... 704/500; 704/203; 704/229

(58) Field of Classification Search ..... None
See application file for complete search history.

(56) References Cited

U.S. PATENT DOCUMENTS

| | | | | |
|---|---|---|---|---|
| 5,294,925 | A | 3/1994 | Akagiri | |
| 5,581,653 | A | 12/1996 | Todd | |
| 5,590,108 | A | 12/1996 | Mitsuno et al. | |
| 5,864,816 | A | 1/1999 | Everett | |
| 5,991,715 | A | 11/1999 | Wiese | |
| 6,185,539 | B1 | 2/2001 | Kunz et al. | |
| 6,625,574 | B1 | 9/2003 | Taniguchi et al. | |
| 7,272,566 | B2 | 9/2007 | Vinton et al. | |
| 7,333,929 | B1 | 2/2008 | Chmounk et al. | |
| 7,337,025 | B1 * | 2/2008 | Absar et al. | 700/94 |
| 7,539,612 | B2 * | 5/2009 | Thumpudi et al. | 704/200.1 |
| 2004/0184537 | A1 | 9/2004 | Geiger et al. | |
| 2004/0225505 | A1 | 11/2004 | Andersen et al. | |
| 2007/0063877 | A1 | 3/2007 | Shmunk et al. | |

OTHER PUBLICATIONS

Yang et al., "Lossless Compression for Audio Data in the IEEE Floating-Point Format", AES Convention Paper 5987, Presented at the 115th Convention, Oct. 10-13, 2003.*

Harada et al., "Lossless Compression of IEEE Floatingpoint Audio using Approximate Common Factor Coding and Masked-LZ Compression", AES Convention Paper 6352, Presented at the 118th Convention, May 28-31, 2005.*

Ghido, "An Efficient Algorithm for Lossless Compression of IEEE Float Audio", Proceedings of the Data Compression Conference, 2004.*

International Search Report and Written Opinion Issued in International Application No. PCT/US2009/003612; Filed: Jun. 17, 2009.

Office Action issued in corresponding Chinese patent application No. 200980135239.7; Dated Apr. 6, 2012.

Written Opinion issued in corresponding Singapore patent application No. 201100425-6; Dated Jan. 27, 2012.

* cited by examiner

*Primary Examiner* — Brian Albertalli

(74) *Attorney, Agent, or Firm* — William Johnson; Gaurav Mohindra; Joel Stoffregen

(57) ABSTRACT

Digital audio samples are represented as a product of scale factors codes and corresponding quantity codes, sometimes referred to as exponent/mantissa format. To compress audio data, scale factors are organized by sample time and frequency either by filtering or frequency transformation, into a two-dimensional frame. The frame may be decomposed into "tiles" by partition. One or more such scale factor tiles are compressed by transformation by a two-dimensional, orthogonal transformation such as a two dimensional discrete cosine transform. Optional further encoding is applied to reduce redundancy. A decoding method and an encoded machine readable medium complement the method of encoding.

30 Claims, 5 Drawing Sheets

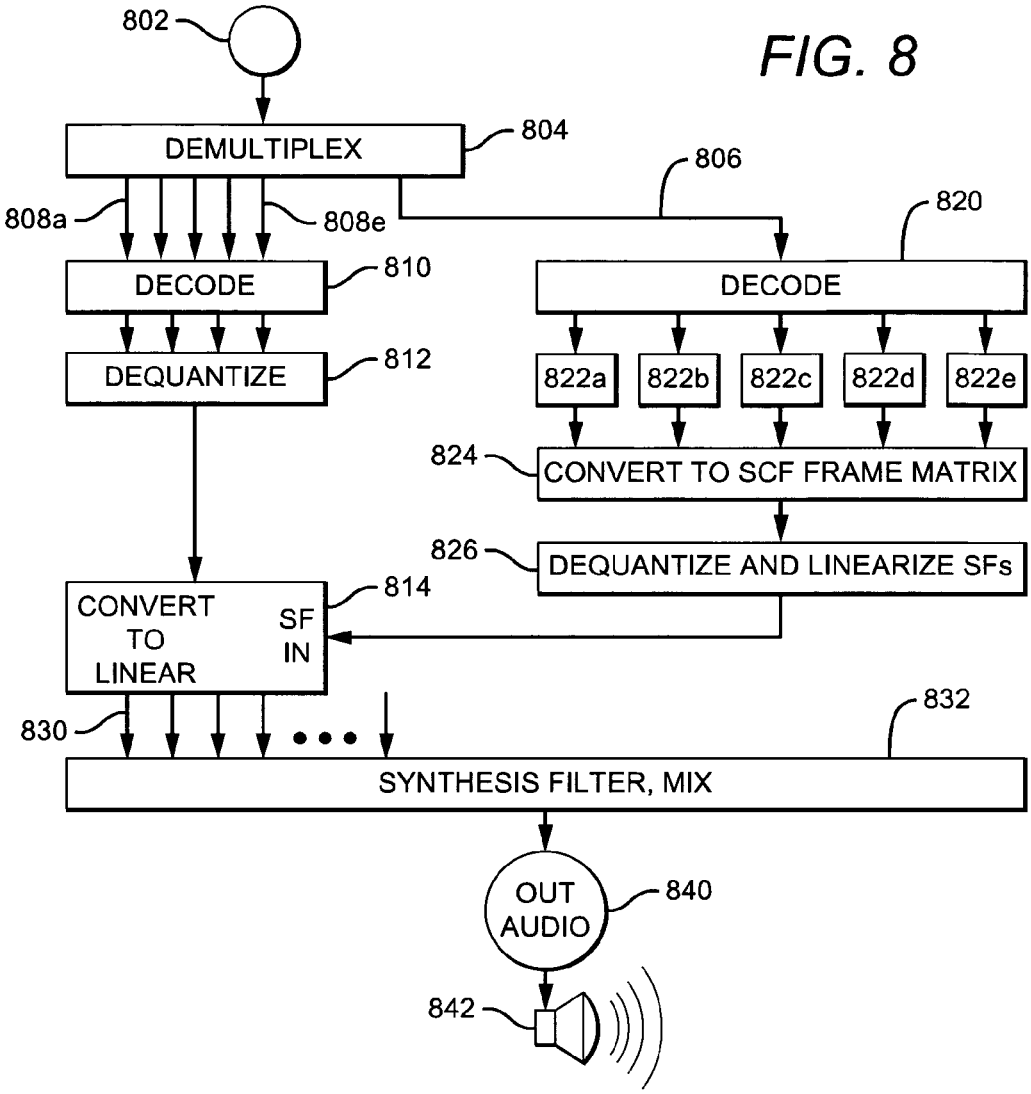
FIG. 8
FIG. 10
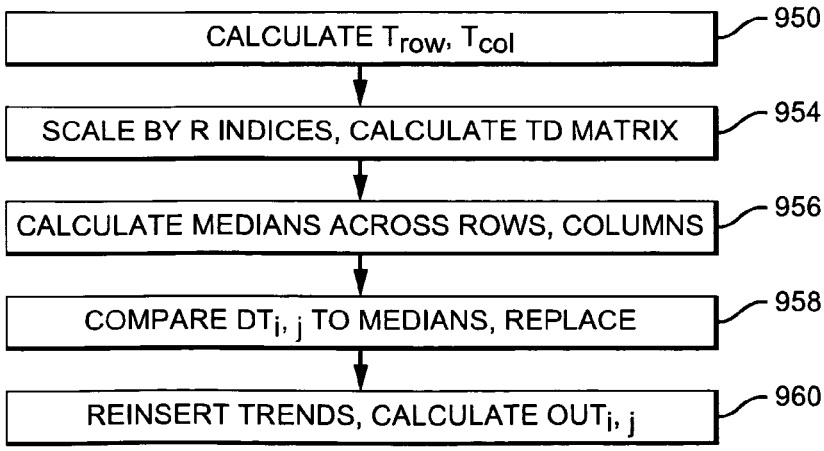

COMPRESSION OF AUDIO SCALE-FACTORS BY TWO-DIMENSIONAL TRANSFORMATION

BACKGROUND OF THE INVENTION

1. Field of the Invention

The invention relates generally to the field of compressed or encoded digital audio signals and more particularly to audio compression that uses scale factors or floating point representation to represent audio signals.

2. Description of the Related Art

A number of methods of coding and decoding digital signals are known, and are typically employed either to decrease the bit requirements for transmission and storage, or to increase the perceived quality of audio playback (subject to a bitrate constraint). For example, some such as DTS coherent acoustics (see U.S. Pat. No. 5,974,380) and Dolby AC3 are in common commercial use, as are numerous variants of MPEG-2 compression and decompression.

In any digital audio representation, the signal is periodically sampled, then the series of samples are quantized by some method to represent an audio signal. In many codecs (encoder/decoder systems), the signal is represented by a series of quantized samples organized as a temporal sequence (time domain representation). In other codecs, the samples may be mathematically transformed by any of a number of mathematical methods, to yield a "frequency domain" representation, also called a spectral representation or a transform representation. Such codecs are often referred to a "transform codecs".

Whether the encoded representation uses time domain samples, encoded spectral values, or some other transformed series of data, it is often found advantageous to adapt the numerical representation of the samples to more efficiently use the available bits. It is known to represent data by using scale factors. Each data value is represented by a scale factor and a quantity parameter which is understood to be multiplied by the scale factor to recover the original data value. This method is sometimes referred to as a "scaled representation", sometimes specifically a block-scaled representation, or sometimes as a "floating-point" representation. It should be apparent that floating point representation is a special case of a scaled representation, in which a number is represented by the combination of a mantissa and exponent. The mantissa corresponds to the quantity parameter; the exponent to a scale factor. Typically the scale factor bits may be represented in some non-linear scheme, such as an exponential or logarithmic mapping. Thus, each quantization step of the scale factor field may represent some number of decibels in a log base 10 scheme (for example).

Although the use of scale factors commonly reducing the bit rate requirement for transmission, in a "forward-adaptive" codec it is required to transmit the scale factors in some manner. At lower bit rates the transmission of the scale factors requires a significant portion of the overall bit rate. Thus it is desirable to reduce the number of bits required to transmit the scale factors. The most common prior approach to this problem is to transmit a single scale factor associated with some larger plurality (block) of samples. One variant of this technique is referred to as "block-floating point." This method strikes a compromise between optimal quantization and the need to reduce the bits required for transmission of scale factors. The success of the technique is largely dependent on the time and frequency behavior of the signal, and signal transients present challenges.

SUMMARY OF THE INVENTION

The invention includes a method of encoding, a method of decoding, and a machine readable storage medium.

The encoding method provides a method of compressing a digitized audio signal representing a sound in an audio compression system wherein a sample is represented as a product of a scale factor and an associated quantity. The method includes the steps of: receiving a digital signal representing a sound; organizing samples into at least one audio frame, the frame comprising a plurality of temporally sequential samples representing a time interval; for each frame, processing the plurality of temporally sequential samples into a plurality of subband signals, each subband signal representative of a respective subband frequency range and comprising a time sequence of audio samples within said subband frequency range; converting said subband signals into a format expressing each filtered audio sample as a product of a) a scale factor, represented in a scale factor field and b) a quantity field, represented in a quantity field; organizing in two dimensions the scale factor fields of said subband signals at least one tile corresponding to each frame; processing said at least one tile with a two dimensional orthogonal transform to produce for each said tile a respective scale factor coefficient matrix (SCM); compressing each said SCM to produce an compressed coefficient matrix; and packing said compressed coefficient matrix in a data format for transmission.

The decoding method includes the steps of: unpacking a received data packet to separate encoded scale factor data and encoded quantity data; decompressing the encoded scale factor data to generate a plurality of coefficient matrices; transforming each of said coefficient matrices by a two dimensional Inverse orthogonal transform, to obtain a plurality of corresponding Scale Factor submatrices; assembling said scale factor submatrices into a larger frame matrix, by concatenating said scale factor submatrices in a predetermined pattern of tiles corresponding to a tiling pattern used in a known encoder; and re-quantizing the scale factor matrix to obtain a decompressed, requantized scale factor matrix.

The machine-readable storage medium is suitable for storing encoded audio information, wherein each sample is represented as a product of a scale factor and a corresponding quantity. The medium has a coded scale factor data field, wherein at least one matrix of scale factors is encoded by a two dimensional orthogonal transformation into a scale factor coefficient matrix; and a quantity field including encoded data quantities.

BRIEF DESCRIPTION OF THE DRAWINGS

FIG. 8 is a procedural diagram showing steps to decode scale factors and audio date encoded by the methods of FIGS. 1-7;

FIG. 10 is a procedural diagram of a novel method of notch removal, useful in the context of the method of encoding shown in FIG. 5.

DETAILED DESCRIPTION OF THE INVENTION

The invention will be described in the context of a "subband codec" which is to say a coding/decoding system that organizes audio samples to some degree both in frequency and in time. More particularly, the description below illustrates by example the use of a two-dimensional scalefactor compression in the context of a codec that uses digital filter banks to separate a wideband audio signal into a plurality of subband signals said subband signals decimated to yield critically sampled subband signals. The invention is not limited to such a context. Rather, the techniques are also pertinent to any "transform codec", which may for this purpose be considered a special case of a subband codec (specifically, one which uses a mathematical transform to organize a temporal series of samples into a frequency domain representation). Thus, the techniques described below may be adapted to a discrete cosine transform codec, a modified discrete cosine transform codec, Fourier transform codecs, wavelet transform codecs, or any other transform codecs. In the realm of time-domain oriented codecs, the techniques may be applied to sub-band codecs which use digital filtering to separate a signal into critically sampled subband signals (for example, DTS 5.1 surround sound as described in U.S. Pat. No. 5,974,380 and elsewhere).

It should be understood that the method and apparatus of then invention have both encode and decode aspects, and will in general function in a transmission system: an encoder, transmission channel, and complementary decoder. The transmission channel may comprise or include a data storage medium, or may be an electronic, optical, or any other transmission channel (of which a storage medium may be considered a specific example). The transmission channel may include open or closed networks, broadcast, or any other network topology.

Encoder and decoder will be described separately herein, but are complementary to one another.

Figure 1:
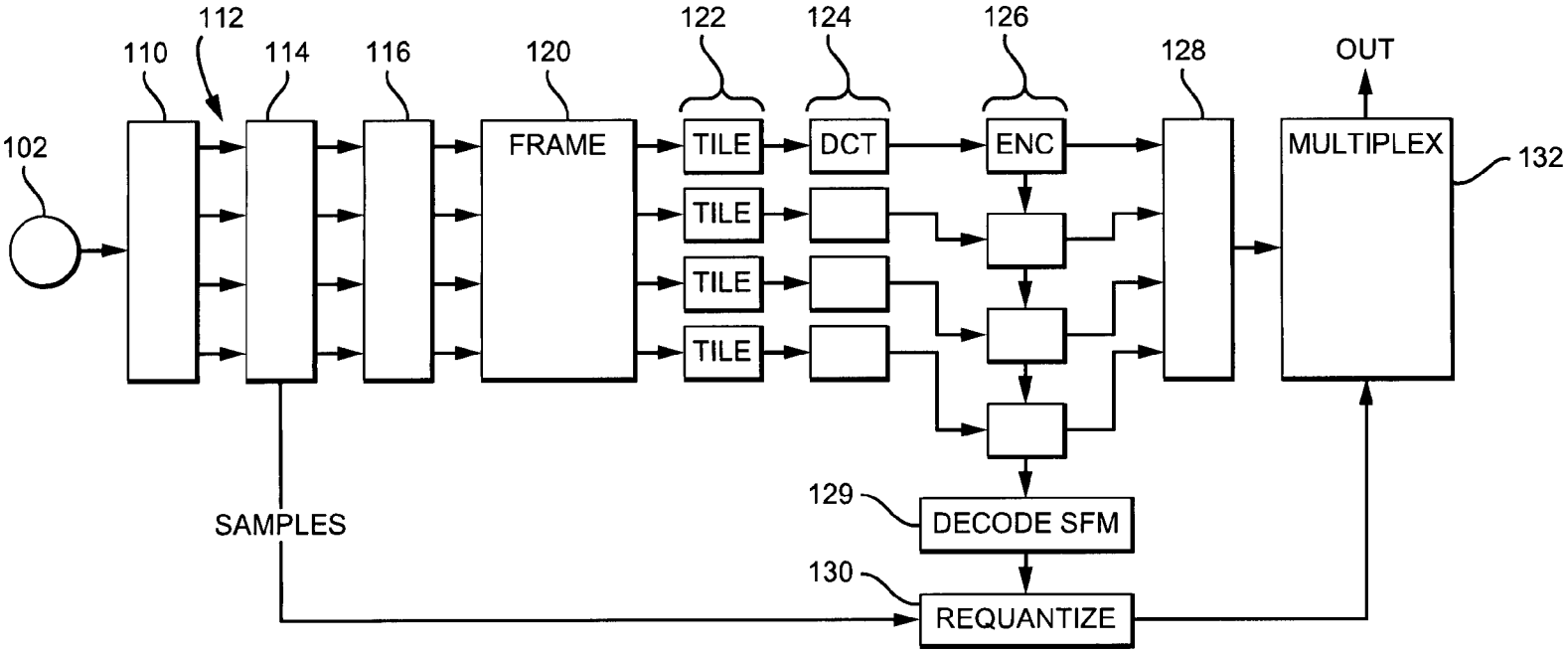
FIG. 1 is a high-level symbolic diagram of a generalized encoder in accordance with the invention, with functional modules shown as blocks.
Figure 2:
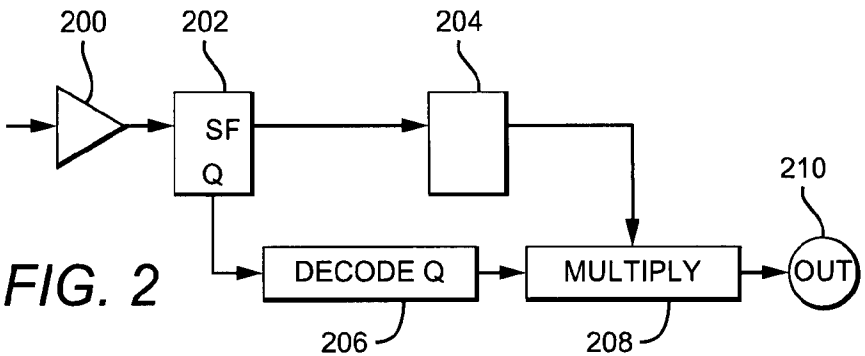
FIG. 2 is a symbolic diagram of a generalized decoder in accordance with the invention.

FIG. 1 shows a top-level, generalized diagram of the encode system in accordance with the invention. More details of a particular novel embodiment of the encoder are given below in connection with FIGS. 5-6.

A digital audio signal of at least one channel is provided at input 102. For purposes of this invention, we assume that the digital audio signal represents a tangible physical phenomenon, specifically a sound, which has been converted into an electronic signal, converted to a digital format by Analog/Digital conversion, and suitably pre-processed. Typically, analog filtering, digital filtering, and other pre-processes would be applied to minimize aliasing, saturation, or other signal processing errors, as is known in the art. The audio signal may be represented by a conventional linear method such as PCM coding. The input signal is filtered by a multi-tap, multi-band, analysis filter bank 110, which may suitably be a bank of complementary Quadrature mirror filters. Alternatively pseudo quadrature mirror filters (PQMF) such as polyphase filter banks could be used. The filter bank 110 produces a plurality of subband signal outputs 112. Only a few such outputs are shown in the diagram, but it should be understood that a large number, for example 32 or 64 of such subband outputs would typically be employed. As part of the filtering function, filter bank 110 should preferably also critically decimate the subband signals in each subband, specifically decimating each subband signal to a lesser number of samples/second, just sufficient to fully represent the signal in each subband ("critical sampling"). Such techniques are know in the art and are discussed in Bosi, M, and Goldberg, R. E., *Introduction to Digital Audio Coding and Standards*, (Kluwer, date unknown), or Vaidyanathan, *Multirate Systems and Filter Banks*, (Prentice Hall, 1993), for example.

Subsequent to filtering by 110, the plurality of subband signals 112 (comprising sequential samples in each subband) are converted by module 114 to a scaled representation. In other words, each sample is converted to a representation comprising a scale factor (encoded in scale factor bits) and a quantity parameter (stored in data bits). The scalefactors may typically be quantized non-linearly, for example in decibels, then further encoded for example by Huffman coding. It should be understood that the sample value is equal to the scalefactor times the quantity parameter, provided that the scalefactor is first decoded to a linear representation. In one common scheme, the samples may be converted into provisional floating point form comprising an exponent and a mantissa, each in previously designated bit fields.

Alternatively, it will be appreciated by those will skill in the art that the input signal 102 may be provided in a floating point format, provided that floating point processing is employed ty the analysis filter bank 110

Module 114 assigns scale factors and data parameters based on a provisional representation scheme, for example a scheme that considers perceptual effects of frequency, such as a subjective masking function. Alternatively, a bit allocation scheme could be used that seeks to optimize some measure of accuracy subject to a bit-rate constraint (such as a minimum least squares error "MMSE"); or the scheme could seek to set a bit rate subject to a predetermined constraint on a measure of error. The initial scale factor assignments are preliminary (in other words, provisional) only, and may be modified later in the method. The scale factors assigned are assigned in correspondence to a non-linear based mapping, such as the decibel or other logarithmic scale. The data parameters (mantissas) may be assigned according to either linear or non-linear mapping.

After conversion to scale factor/quantity representation, the plurality of subband signals are further encoded by encode module 116. The data may be encoded by any of a variety of methods, including tandem combinations of methods intended to decrease bit requirement by the elimination of entropy. Lossy or lossless methods could be used, but it is expected that lossy methods would be most effective to the extent that the method can exploit known perceptual characteristics and limitations of human hearing. The encoding of the data parameter is incidental to the invention, which primarily concerns the compression of the scale factor data (which is associated with the data parameters on a sample by sample basis).

Next, in processing module 120, the provisional scale factors in each subband are grouped into frames, more specifically, a "frame" of subband samples is defined in two dimensions, based upon sequential associations in two dimensions: time and frequency. A specific method of arrangement into a series of matrices is discussed below in connection with FIG. Although four signal pathways are shown in FIG. 1, corresponding to four "tiles," other numbers of tiles could be employed, or only a single tile could be employed in some embodiments.

Next, in scale factor compression module 122 the provisional scale factors are preferably grouped into a plurality of matrices or "tiles" that are smaller than the dimensions of a frame, said plurality of tiles sufficient at least to represent the frame. The scale factors are then modified (as more specifically described below in connection with) and compressed by use of a two-dimensional transformation 124, preferably by a two-dimensional discrete cosine transform (DCT). This operation produces a modified scale factor matrix representing a frame of scale factors. The DCT transformed scale factor matrix (referred to as the scale-factor coefficient matrix) is then further processed and encoded (in blocks 126) to remove entropy. Details are discussed below. It has been found that the scale-factor coefficient matrix can be compressed significantly after DCT transformation. The compressed scale factor matrix is then stored for transmission (module 128).

To prepare data for transmission, the encoder must decode the compressed scale factor matrix (by decoder 129) to reconstruct a reconstructed scale factor matrix (which may vary to some degree from the original "provisional" scale factors). Using the reconstructed scale factor matrix, the Encoder next re-quantize the original subband samples (re-quantize module 130). Finally, the compressed scale factor matrix (or more accurately, a greatly compressed code decodable to reconstruct such a matrix) is multiplexed (by multiplexer 132) with compressed data parameters into some data format or "packet" which is then transmitted. Alternatively, the data format prepared by the invention may be stored on a machine-readable medium. In other words, for purposes of this application, data storage and later retrieval may be considered as a special case of "transmission".

In addition to the manipulations and compression steps given herein, it should be understood that other "layers" of encoding may be and generally would be present. The compressed audio packets might be further manipulated as required by the transmission medium, which might require IP protocol, addressing bits, parity bits, CRC bits, or other changes to accommodate the network and physical physical layers of a data transmission system. These aspects are not the subject of the present application, but are understood by those with skill in the relevant art.

At the receive end of the data transmission system, data packets are received by receiver 200, and demultiplexed (in other words, data fields are unpacked from their multiplexed format) by demultiplexer 202. The encoded scale factors are decoded to reconstruct a reconstructed scale factor matrix by scale factor decoder 204, by reversing the process of encoding the scale factor matrix. The steps are described in greater detail below in connection with FIG. 8. The audio quantity parameters are also decoded by a quantity field decoder 206 by a method complementary to whatever method was used to encode those quantity parameters. The reconstructed scale factors and quantity parameters are finally reassembled in association for each sample (reconstruct scaled data). Finally, the scaled data can be decoded or expanded by multiplication (in block 208) to yield fixed-point or integer audio data representing the decoded values for each audio sample. The output of 208 is a series of sequential data representative of an audio signal. The (digital) output 210 can be converted by D/A converter to an audio signal such as a voltage or electrical current, which in turn can be used to drive speakers or headphones, thereby reconstructing a near-replica sound.

It should be understood that although only one audio channel is described, the techniques of the invention could be used to encode a plurality of audio channels, whether in a 2 channel stereo configuration or a larger number of channels, such as in one of various "surround" audio configurations. Optionally, inter-channel correlations might be exploited by the decoder to improve compression in a multi-channel embodiment.

Either or both of the Encoder and Decoder described generally above (and particularly below) could be embodied by an appropriately programmed microprocessor, in communication with sufficient random access memory and data storage capabilites, in communication with some data transmission or storage system. For example, general purpose microprocessors such as the ARM 11 processor available from various semiconductor manufacturers, could be employed. Alternatively, more specialized DSP processor chips such as the DSP series available from Analog Devices (ADI) could be used, greatly facilitating the programming of multibank FIR digital filters (for the subband filter banks) or of the transform operations (DCT or similar). Multi-processor architectures could be advantageously employed.

A more specific description of a particularly novel method is next described, with emphasis on the method of compressing scale factors which is the primary focus of the invention. From the general description above, it will be appreciated that the quantity parameters (Q), sometimes also called "mantissa" fields, must be appropriately handled and compressed in one-to-one association with the scale factors, always preserving the relationship that an audio datum should be closely approximated by the product of the scale factor SF and the quantity (Q) field, in a scalefactor/quantity representation. The following detailed description focuses more particularly on the compression of scale factors in the invention. The description is given in the context of a subband codec employing multiband, FIR subband filters operating on a time domain sampled signal to yield critically sampled subband signals. The technique could be adapted for use in a transform codec with only slight modifications, which will be apparent to one with skill in the art.

Figure 3:
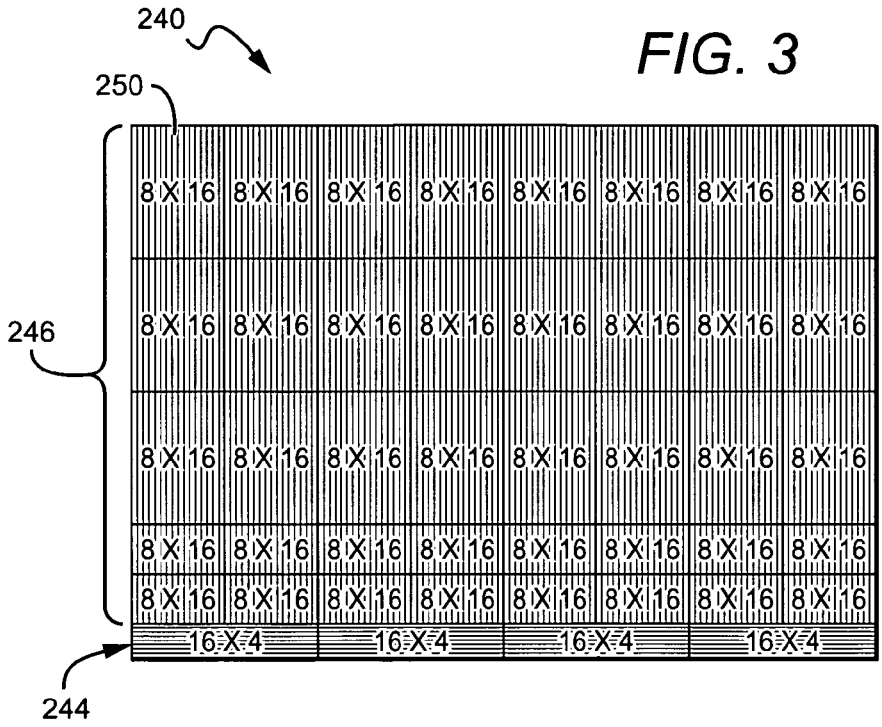
FIG. 3 is a graphic representation of a data matrix, corresponding to a matrix of scalefactors separated into subbands and organized by sample time, with differing subbands distributed by frequency on a frequency axis, and differing times organized by sample time on an orthogonal time axis.

The further explanation of the method is greatly facilitated by the visualization of a two-dimensional data structure or matrix as shown in FIG. 3. The grid 240 represents a N by M dimensioned matrix of scalefactors, where N the number of subbands represented and M is the number of temporally sequential samples in each subband, considered over a time span equal to a frame of audio data. The exact dimensions (N and M) are not critical: specific values given are for ease of explanation only. For example only, consider an audio "frame" comprising a temporal sequence of N*M equal to 1024 consecutive PCM represented samples. By passing such a sequence through a subband filter bank, it may be decomposed into N subbands. In a typical codec, N might suitably be chosen to be 32. Each subband would then typically be decimated by a factor of 32 ("critically sampling") without loss of information (see Bosi, cited above for further description). In that specific example case, each subband would yield (for a single audio frame) 1024 divided by 32 equal to 32 sequential samples. Such an arrangement of a "frame" would usefully be represented by a 32 by 32 matrix of samples. For purposes of this application, it is only necessary to consider the scalefactor component of each sample. Thus, a scalefactor "frame" is represented by an N by M matrix of scalefactors. In the more general case, it is not necessary that the subbands all have equal frequency span; nor is it necessary that the time resolution in each critically sampled subband be the same, so long as the temporal and spectral information is completely captured. Accordingly, FIG. 3 depicts a frame having 46 (unequal) subbands; most of the subband have 128 temporally sequential samples. The low frequency subbands 244 are filtered and decimated to have only 16 temporally sequenced samples per frame (with more narrow bandwidth compared to the bands 246 having 128 samples per frame).

It should be easily visualized that FIG. 3 completely represents frame of N times M audio scalefactors in a two-dimensional matrix form. In a preferred embodiment of the invention, the matrix 240 is partitioned into a plurality of "tiles" 250*a*, 250*b*, etc. The "tiles" are matrices of smaller dimensions which can be concatenated in two dimensions (time and frequency) to completely construct the matrix 240. More specifically, a "tile" for our purposes is a matrix of dimensions J by K where J and K are less than or equal to N and M respectively, wherein each J by K tile consists of sequential range of scalefactors, retaining the frequency, time ordering from the matrix 240. In other words, tiles are obtained from the matrix 240 by partitioning the matrix; the matrix 240 can in turn be constructed by concatenating the submatrices (tiles) in a predetermined pattern in two dimensions. For discussion of partition and submatrices, see *The Penguin Dictionary of Mathematics*, John Daintith and R. D. Nelson, Eds. (1989).

Although a single tile spanning an audio frame matrix could be compressed in accordance with the invention, deconstruction of the larger matrix 240 into a plurality of smaller tiles is preferred in a particularly novel embodiment of the method of the invention. Thus, in some variants of the invention, the audio frame matrix 240 is decomposed by partition into submatrices. In the example shown in FIG. 3, tiles of various dimensions are used. Specifically, the lowest 16 subbands in the example are represented by 16 by 4 tiles (frequency, time). The next 2 subbands in increasing frequency are partitioned as 3 by 16; the higher frequency subbands are partitioned as 8 by 16 submatrices. The indicated dimensions have been found useful for representing an audio signals with audio bandwidth in the usual range for medium to high fidelity musical signal (up to approximately 20 Khz bandwidth). Other patterns of tiling could be employed.

Figure 4:
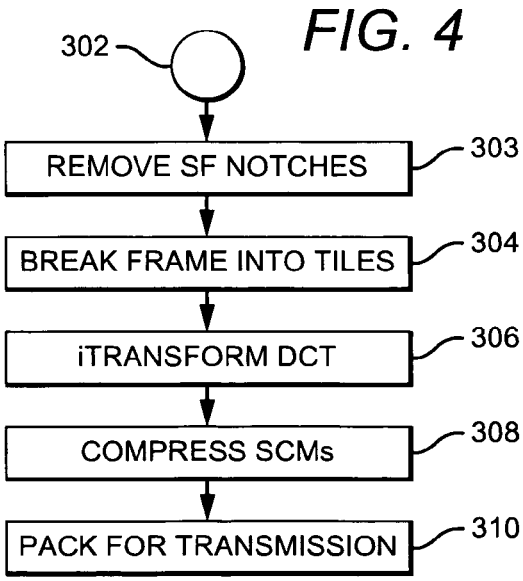
FIG. 4 is a high level procedural or "flow" diagram showing at a general level the steps of an encode method in accordance with the invention.

FIG. 4 is a block diagram presenting more details of a more specific embodiment of the encoder according to the invention. A series of digital audio samples is received as input at node 302. A sequence of ordered PCM audio samples is appropriate. Typical data rate are contemplated to be in the region 32 Khz to 48 Khz sampling rate (with bit rates from 8 Kb/s to 320 Kb/s). Higher rates would also be feasible, but at these relatively low sample rates the invention provides the most marked advantages, because at low bit-rates the scalefactors comprise a significant fraction of the total data.

Step 303, an optional "Notch Removal" step, is included in certain specifically novel variations of the invention, as described below in connection with FIG. 10. This step is preferably included to smooth the scale factor frame matrix and prepare it for more efficient compression in the subsequent steps. The next method step 304 is to decompose the scalefactors into a plurality of tiles, said tiles being matrices of dimensions lower than that of the entire frequency/time audio frame and said tiles being complete and sufficient to reconstruct by ordered concatenation the entire two-dimensional audio frame. It will be apparent that many different tiling patterns could be used. The example shown in FIG. 3 is merely one example and not intended to limit the scope of the invention.

Next, in step 306 for each tile the invention processes the scale factors by an orthogonal functional transformation, and most preferably by a two-dimensional discrete cosine transform (hereinafter simply "DCT"). For example, either of the two-dimensional DCT given in Rao and Hwang, *Techniques and Standards for Image, Video and Audio Coding*, pg. 66 (Prentice Hall, 1996) could be used (in a context wholly different from that given in the reference). Different normalizations of the DCT could be substituted without departing from the invention. The result for each tile is a J by K matrix herein referred to as a scalefactor coefficient matrix (hereinafter "SCM"). Note that this step differs entirely from the use of DCT in image compression in that the transform acts on scale factor indices, which represent a non-linear quantization scheme. The scale factors are not analogous to an image quantity such as intensity or chroma, nor do they correspond directly with a sampled amplitude.

It should be noted that although the description refers repeatedly to "DCT" as the frequency or matrix transform to be employed, other orthogonal tranforms are known which could be equivalently substituted, such as wavelet, discrete Fourier transform, Karhunen-Loeve transform, or other transforms.

The SCM from each tile typically occurs in a form which may be more easily compressed (as compared to the scalefactor matrices).

Next, in step 308 the SCMs are compressed. In accordance with a most generalized aspect of the invention, the SCMs associated with the tiles in a frame may be compressed by any method which reduces the bit requirement for transmission while preserving a deterministic method of re-calculating the scalefactors with an error within acceptable tolerance for psychoacoustic audio compression. More specifically, in a particular novel embodiment the invention includes the step of compressing the SCM by an entropy reducing method of encoding. To be even more particular, in one particular novel embodiment the invention includes compressing the SCMs by at least the several steps: a) requantizing the SCMs by in accordance with a requantizing matrix, b) compressing at least the DC coefficients by a differential coding method, c) encoding the coefficients (other than the DC coefficients by a coding method that reduces redundancy, such as any combination of differential coding, vector coding, or Huffman coding. The encoded scale factor coefficients are then packed (in other words, multiplexed) for transmission (step 310).

Figure 5:
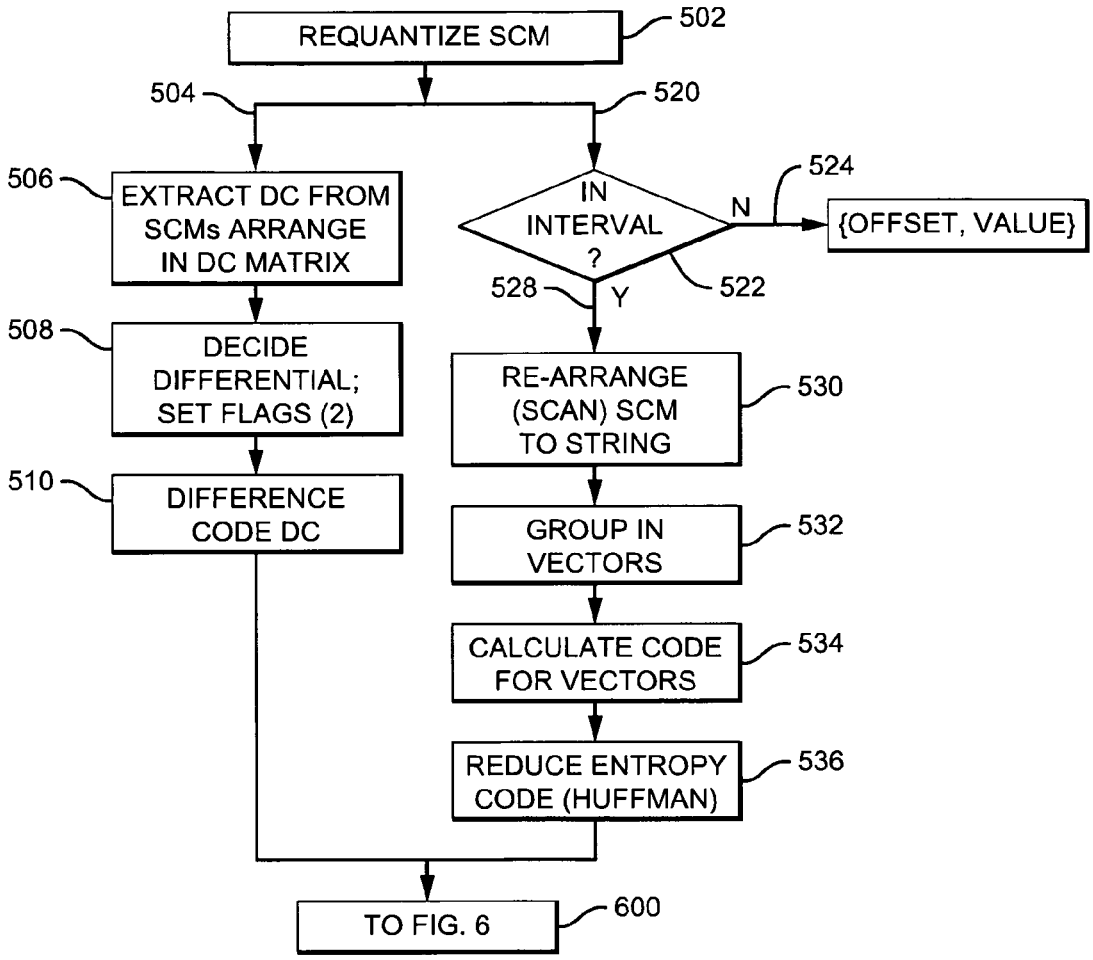
FIG. 5 is a procedural diagram showing specific steps of a particular method of compressing scalefactor coefficient matrices (SCMs), this particular method useful in a particular embodiment of the invention to compress SCMs in FIG. 4.

An even more specific and particular method of compressing the SCMs is shown in the flow diagram of FIG. 5. This figure shows a particular and novel instance of the SCM compression step 308 (in FIG. 4). This particular method has been found suitable, and employs a combination of differential coding, vector coding, and Huffman coding to reduce the bit requirement for transmitting the scale factors. Focusing on the compression of scalefactors, the data to be compressed represent the DCT transform coefficients of scalefactors; said scalefactors represent by a non-linear mapping a set of multipliers (or exponents); and each multiplier is associated in one-to-one correspondence with an audio quantity field (mantissa). For example, in one embodiment a scalefactor might consist of short byte representing a base level expressed in decibels, implicitly related to amplitude by a log base 10 mapping. Because the scalefactors are not simple amplitudes or linear quantities, the conventional methods for compressing linear PCM data, or even conventional image data, would not be expected to function to advantage with non-linear scalefactor data. Encoded scale factor data is not analogous to amplitude in audio or to conventional image quantities; thus, one with skill in the art would not expect to use analogous techniques to compress non-analogous quantities.

Before further encoding, the SCMs from all of the tiles are preferably requantized (step 502) in recognition that certain of the DCT coefficients are more critical than others. In one advantageous embodiment, the coefficients are quantized according to the a 3 by 16, requantization matrix M as exemplified in Equation 1:

$$M=2,3,3,3,3,3,3,3,0,0,0,0,0,0,0,0,3,3,3,0,0,0,0,0,0,0,0 based on measured signal statistics. A particular and novel solution is described below by way of example.

In one particular coding solution, the string of selected coefficients are then grouped (step 532 ) into groups of 4 elements (vectors). The grouping into groups of four makes the later employed Huffman coding process more efficient. With 4 elements there will be 16 possible codes (if signs are excluded) For +/−1 values, the sign may be stored as a separate bit. Next, in step 534 the method calculates arithmetically a unique code based on the 4 coefficients (c1,c2,c3,c4) of each vector. For example, in one embodiment a code is calculated equal to the absolute value of c1, plus twice the absolute value of c2, plus four times the absolute value of c3, plus eight times the absolute value of c4. Other methods of calculating such arithmetic codes are known, and any coding scheme may be employed that reduces the required number of bits for transmission of each vector. Finally, the calculated Codes from step 534 are treated as symbols, and each further encoded in step 536 by a variable length code such as a Huffman code which reduces bit requirement by exploiting the unequal probabilities of occurrence of different symbols.

The steps 502 through 536 set forth above are performed for each tile in a plurality of tiles, said plurality capable of arrangement into a time/frequency matrix as shown in FIG. 3 to completely specify the scale factors through an audio frame. Accordingly, the steps of FIG. 5 should be repeated for each tile in every audio frame. Optionally, in some embodiments it is desirable to code one tile in a group by the method of steps 502 through 536, then encode other tiles differentially. In other words, coefficients of a first tile are first encoded; the coefficients of adjacent tiles are then represented by, for each element in the coefficient matrix, representing the change from the corresponding entry in the previous (or frequency adjacent) tile. Either difference across time or across frequency could be used. A flag or flags should be transmitted to designate whether time difference coding, frequency difference coding, or straightforward value coding is employed for each frame.

Figure 6:
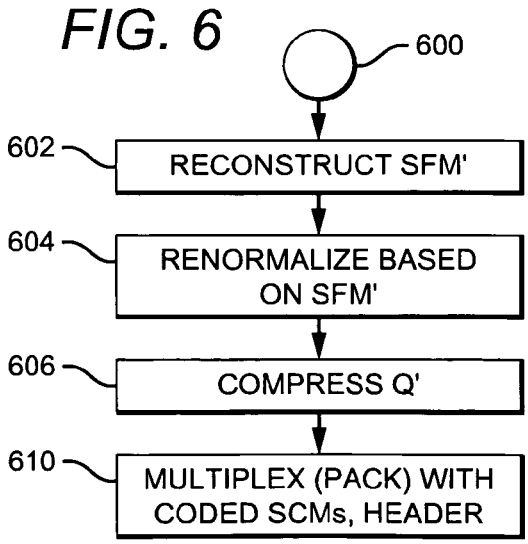
FIG. 6 is a procedural diagram showing a continuation of the method of FIG. 5, including steps to further compress SCMs and quantity parameters for transmission through a communication channel.

Refer now to FIG. 6, which begins from method node 600 shown as endpoint on FIG. 5. After compressing the scale factors, it is most desirable to reconstruct the scale factors at the encoder in step 602, based on the compressed scale factor data, to obtain a reconstructed set of scale factors. This is done by reversing the steps of encoding the scale factors, as set forth above, or equivalently by applying the steps of the decoding process described below in connection with the decoder aspect of the invention. The reconstructed scale factors should preferably be used to renormalize the samples (step 604) by recalculating each sample in scalefactor/quantity format as required to most closely match the originally represented audio data on a sample by sample basis. The reconstructed scale factors will in general differ from the provisional scale factors assigned in module 114 of FIG. 1 above. For any individual sample, if the original, provisionally quantized data is represented by SF*Q=sample value, then the final data (Q') should be recalculated as value/RSF where RSF is the reconstructed scale factor for a particular sample. Preferably, the set of final audio data (Q') should then be compressed (step 606) for transmission.

Figure 7:
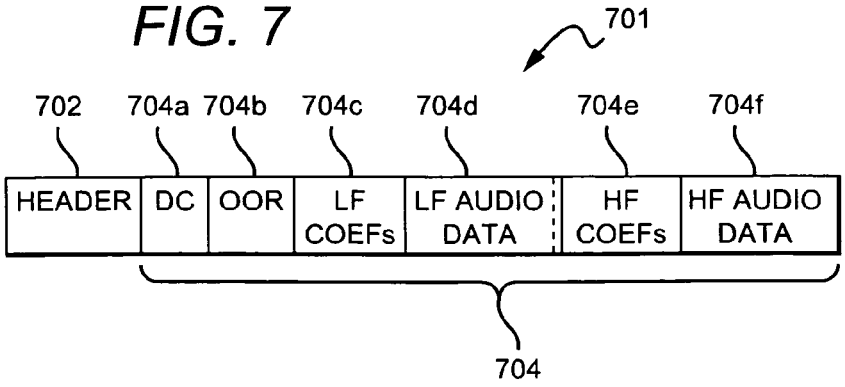
FIG. 7 is an example of a data format suitable for packing a frame including encoded scale factor and audio quantity data for transmission or recording.

Finally, the compressed scale factors and the compressed final audio data should be packed (step 610) into a data format for transmission. More particularly, in the example embodiment described above, it is necessary to multiplex together by some method the final audio data, the compressed DC components, the "stray" coefficient data, and the compressed coefficient data. It is most preferable to pack together in a common ordered format all the respective data corresponding to an audio frame, said frame defining the audio events from a given pre-determined time interval of the audio signal. One suitable format is shown in FIG. 7. The exemplary data format comprises a series of audio frames, preferably of predetermined size although variable sizes could be used with adaptation of the method. A single frame is shown generally as 701 in FIG. 7. Preferably the frame begins with header information 702, which may include general information on format, coding options, flags, rights management, and other overhead. Next, in fields 704, scalefactor data is packed, suitably in the following order: First DC coefficients of the tiles are packed in a predetermined order in field 704*a*. Next, packed values of out-of range ("OOR" for out of +1 to −1 range) non-DC coefficients (AC coefficients) are packed in 704*b* in a predetermined order for each tile, within a larger tiling order. Next, in field 704*c*, the "in range" encoded coefficients of low frequency tiles are arranged in a predetermined order for each tile, within a larger tiling order. The next field 704*d* contains coded audio quantity data corresponding to the low frequency tiles. Following 704*d*, the remaining coefficients (in range +1 to −1) pertinent to the higher frequency tiles are packed in 704*e*. After 704*e*, the packed, encoded audio sample data from the higher frequency tiles is packed in 704*f*. In a typical application, this ordering may be accomplished by simple time-domain multiplexing of data, and has the advantage that more psycho-acoustically important elements appear first in the bitstream. Thus, if bandwidth or processor time is inadequate, the less important higher frequency scale factors and sample data may be simply dropped, and the signal may still be decoded (with reduced frequency range in the reproduced audio). Other packing schemes and other methods of multiplexing may alternatively be employed, as dictated by the needs of a particular communication channel.

After the compressed audio is transmitted (or stored) and received (retrieved), it can be decoded by a process complementary to that employed by the encoder. Essentially, the decode method reverses the steps of the encode method to recover scale factors. FIG. 8 shows a block diagram of a decoder apparatus in accordance with the invention. Input from a received bitstream at 802 is demultiplexed by demultiplexer 804 which separates the received data format into encoded scalefactor data at path 806 and sample data in a plurality of subband branches 808*a-e*. The actual number of such branches is in a given embodiment dependent on the tile pattern used in a particular encode embodiment, which must be either matched to the decoder or else information must be transmitted forward to inform the decoder of the tiling pattern. The encoded audio data is decoded in step 810 by reversing the quantity coding (from step 606) and dequantized (812) in each subband in accordance with the quantization scheme applied at the encoder.

Encoded scale factor coefficients are decompressed (step 820) by reversing the coding, previously performed in FIG. 5, to yield scale factors coefficient matrices. These matrices are next transformed by an inverse orthogonal transform complementary to that used to encode, most suitably by Inverse Discrete Cosine Transform in steps 822*a-e,* which are matched to the rectangular dimension of each of the tiles applied during encoding. To associate each scale factor with its corresponding audio data (mantissa), it is convenient to group the recovered scaled factors (in step 824) into a two-dimension data frame by concatenating a plurality of tiles to form a larger matrix spanning both the bandwidth and a continuous and complete time frame. In other words, the scale factors are stored in a data structure corresponding generally to the frame illustrated in FIG. 3, above. The associated audio data are grouped in the same or a parallel structure.

After the scale factors are recovered, they are used to recover a near-replica of the original source audio samples as follows: In each of a plurality of subbands, The scale factors corresponding to logarithmic quantities (decibels) are then exponentiated to obtain linear scale factors (in step 826). The audio samples are then reconstructed by multiplying (in "convert to fixed" step 814) the linear scale factor for each sample by the audio data (Q, or in other words, mantissa) corresponding to the same sample. The resulting subband signals still correspond to a frame structure in a form generally like FIG. 3.

To recover audio in the form of a wideband sequence of audio samples, it is further required to inversely process the time-frequency matrix of audio samples into a sequence of wide-band audio. The method employed to reconstruct a wideband series of time sequential samples will depend upon the particular embodiment. We consider first an embodiment employing time-domain digital filters (such as QMF or polyphase filters). In such an embodiment, the subband samples in each subband are shifted out of the matrix in time sequence, from oldest to most recent, with subbands in parallel paths 830 into a synthesis filter step 832. In the synthesis filter step 832, the critically sampled audio subband samples are upsampled then filtered through a parallel series of synthesis filters matched to those used at the encoder. The parallel subband signals are also mixed in step 832 to reconstruct a wideband sequence of audio samples at output 840. The output sequence will be a near replica of the source audio (input to FIG. 1).

In an embodiment using transform techniques, the method would differ from that described in the previous paragraph. Instead of synthesis filtering, the method would follow the steps: First, inverse tranformation of each column of the frame SF matrix (a set of frequency bins), followed by inverse windowing to obtain a sequential, time-domain series of audio samples. The details of a transform based embodiment can be readily realized by one skilled in the art. For more information one may consult such works as Vaidyanathan or Bosi (both cited above).

The decoded audio signal at 840 may be stored or further processed by a receiver. At some time it is understood that the decoded audio data shall be converted to an analog electronic signal by a D/A converter, amplified, and used to reproduce sound for a listener. These functions are grouped together and symbolized commonly by the speaker module 842. The apparatus and method of the invention thus produce a tangible physical effect both in the interim (by producing electronic data signals, capable of transmission and storage) and ultimately (by causing a sound to be emitted from a transducer, the sound a replica of a previously recorded or transmitted sound).

Figure 9:
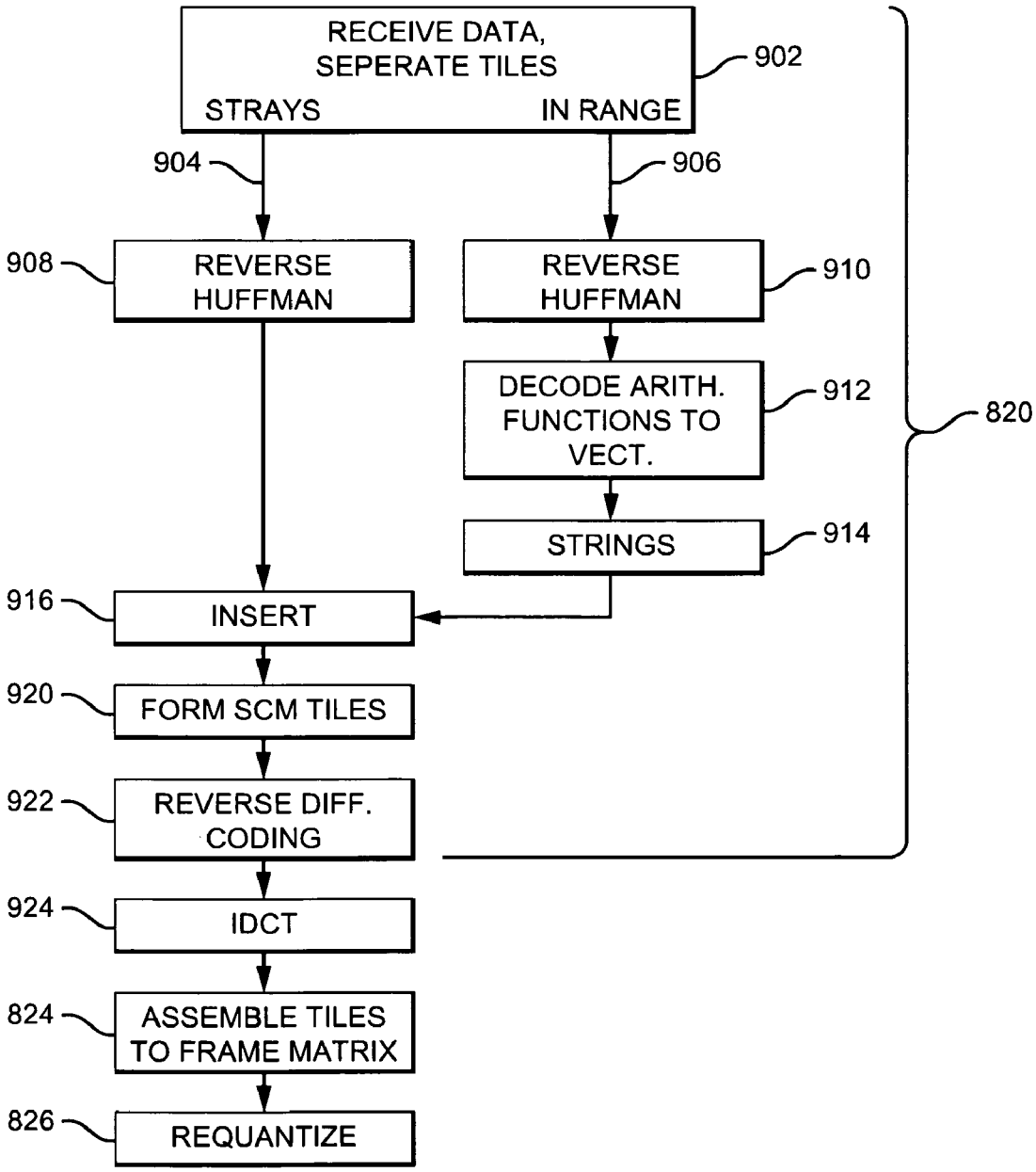
FIG. 9 is a procedural diagram showing steps of a particular embodiment, showing more particular steps useful in decoding scale factors and audio data encoded by the methods of FIGS. 1-7.

FIG. 9 more particularly shows the steps of a more specific, novel embodiment of the decoder. These steps are particularized to enable construction of a specific example decoder, that example coder which is complementary to the example encoder discussed above in connection with FIGS. 1-7. The more particularized details pertain primarily to a particular method of encoding scale factors; for this reason data pathways relating to the mantissas are not shown but are understood to be present in the invention.

The steps described herein are specific and particularized details of the modules 820, 822*a-e*, 824, and 826 which were described more generally above. This particular embodiment is found to be effective at relatively low bit rates to achieve in the neighborhood of 30 per cent reduction in bit requirement for the decoder.

In block 902, the decoder receives the unpacked data (demultiplexed previously in step 804 of FIG. 8) and separates the transmitted data into corresponding tiles. Based on the setting of transmitted flags, the decoder will determine whether differential coding has been used or not. This decision will affect the method of decoding tiles, below.

Next, the decoder proceeds to decode the coefficient data. "Strays" (recognized in demultiplex step 804) are decoded by a method following path 904; "In-range" coefficients are decoded via path 906.

For stray values in path 904, first the Huffman (or other entropy reducing code) is reversed (step 908) to yield vectors, said vectors representing the strays as (position, value).

For "in range" values in path 906, the method decodes Huffman codes to yield a set of arithmetic codes (step 910). The arithmetic codes each correspond to a unique 4 vector. The arithmetic codes are then decoded (in step 912) by a method complementary to that used to encode the 4 vectors, to yield a series of 4 vectors. The vectors are then concatenated to form strings (step 914) and the the stray values are inserted (step 916). The strings are then rearranged (step 920) into SCM tile (submatrices of a frame matrix) by following a scanning pathway (such as a zig-zag scan) which corresponds with that used in the encoder to form strings.

For tiles coded by differential coding, it is necessary to sum matrix entries with those in adjacent matrices to reverse differential coding (step 922). Once the SCM tiles have been reconstructed, they are processed with an orthogonal transform inverse to that used in encoding, preferably with an inverse discrete cosine transform (IDCT) in two dimensions (step 924). (It should be understood that step 924, the IDCT, corresponds to step 832 in FIG. 8, as FIG. is a special case of the more general method shown in FIG. 8.) These steps produce a series of scale factor tiles.

After reconstruction, the scale factor tiles are preferably concatenated in a predetermined pattern into a larger, frame matrix (step 824). This concatenation simply appends submatrices into a larger matrix in a pattern complementary to that used to partition the matrices into tiles (in step 304 of FIG. 4, in the encode method). The resulting scale factor matrix is then converted (or in other words, requantized in step 826) to a linear scale factor, according to a function complementary to that employed in the encoder. In a typical application this step comprises converting from a decibel scale to a linear scalefactor. (The general term, "Requantize" in this context refers to dequantization or, in other words, expansion as from a logarithmic to a linear scale. It may also be used in other contexts to refer to the process of requantizing for the purpose of compression.)

In one particularly novel embodiment of the invention, efficiency of coding is further enhanced by a method of "notch removal" as applied to the scale factor data before transformation and further encoding. This step is shown as step 305 in FIG. 4, would be suitably used after breaking the frame into tiles (step 304) and before step 306.

It has been observed by the inventor that after organization of preliminary scalefactors into matrices, the rows and columns of such matrices exhibit numerous "notches". In other words, there are areas where an otherwise generally linear trend is interrupted by a low value. These notches increase the complexity of the coefficient matrix after transformation, making the scale factor data less compact.

Accordingly, in one novel embodiment of the invention the "notches" in scale factor data are removed by the method set forth herein. The notch removal method includes modifying said at least one tile by a prediction model that models a matrix by a calculated trend across at least one of a) rows, and b)columns, to obtain a modified matrix of scalefactors. The scale factor matrix is in effect replaced by a modified, smoother scale factor matrix before further processing in the encoding methods of FIGS. 4-5. In a simple method, a linear prediction model is applied. Alternatively, the method can be modified to apply a polynomial predictive model.

The notch removal method is shown in FIG. 10. For purposes of description of the notch removal method, we consider as input an N×K matrix D of scale factor values $D_{i,j}$. First, a linear trend (scalar) $T_{row}$ is calculated (step 950) as a simple linear-weighted, normalized sum of values as shown in Eq. 2a:

$$T_{row} = \frac{2 \cdot \sum_i \left( \left[ \frac{\sum_j D_{i,j}}{K} \right] \cdot i \right)}{N} - \frac{\sum_{i,j} D_{i,j}}{KN} \quad \text{Eq. 2a}$$

Enclosed within square brackets is the column-wise averaging. The second term in subtraction is the average value. Similarly, for columns the method calculates a column trend (scalar) $T_{col}$ (step 952) by:

$$T_{col} = \frac{2 \cdot \sum_j \left( \left[ \frac{\sum_i D_{i,j}}{N} \right] \cdot j \right)}{K} - \frac{\sum_{i,j} D_{i,j}}{KN} \quad \text{Eq. 2b}$$

It is possible to employ other means for trend calculation, provided that the method provides some average slope across the row (or columns) of the matrix. The first trend is a scalar $T_{row}$; The second trend is a scalar $T_{col}$.

After this calculation, the trends are scaled by the row and column index and subtracted (step 954) from the matrix D according to the equation:

$$DT_{i,j} = D_{i,j} - T_{row} * i - T_{col} * j \quad \text{Eq. 3:}$$

Median values are then calculated across each of the rows of the matrix DT, resulting in a vector of N median values $M_{row}i$ (step 956). Similarly, median values are calculated across columns of the matrix, resulting in a vector of K median Values $M_{col}j$ As used in this disclosure, "median" is used to denote the number separating the higher half of a population from the lower half.

Next, each member of the matrix DT is tested against the calculated median values (for row and column). If DTi,j is higher than any of the median values, no action is taken. If DT is lower than both median values, then the value of the lowest median is assigned to replace the value in DT (step 958). Therefore:

$$DT_{i,j} = \min(M_{rowi}, M_{colj}) \quad \text{Eq. 4}$$

The trends are then reinserted (step 960) by adding:

$$\mathrm{OUT}_{i,j} = DT_{i,j} + T_{row} * i + T_{col} * j \quad \text{Eq. 5}$$

The matrix OUTi,j is substituted as the scalefactor matrix, and used in further encoding steps as a "smoothed" scalefactor matrix.

It should be appreciated that the matrix OUT has been smoothed by notch removal; inasmuch as the provisional scalefactor assignment was previously carried out in some optimal manner, the quantization according to the matrix OUT will be sub-optimal in terms of quantization noise. However, the suboptimal scalefactors will be confined to those matrix entries which represent a slot between higher scalefactors: either a frequency band sandwiched between two frequencies with higher signal levels; or a short time slot adjacent to a time slot with higher amplitude signal the first case is a situation in which psychoacoustic frequency masking is expected to occur; the second case corresponds to a quiet passage adjacent to a loud transient (temporal masking should occur). In both situations, less than optimal quantization is tolerable because of psychoacoustic masking phenomena. Possibly for these reasons, the smoothing of the scalefactor matrix by notch removal has been found to reduce bit requirement for coding, while offering subjectively acceptable replication of the signal. Alternatively, the additional bits can be allocated to improve signal to noise in regions that are more psychoacoustically sensitive.

While several illustrative embodiments of the invention have been shown and described, numerous variations and alternate embodiments will occur to those skilled in the art. For example, as mentioned above, various transforms such as Fourier Transform, DCT, or modified DCT transforms could be employed to separate the audio signal into subbands (in other words, bins), thereby producing two-dimensional frames. Various functions could be used to define scalefactors in a non-linear mapping, other than a decibel scale. Different data formats, different entropy reducing codes, and different tiling patterns and frame sizes could be used. Such variations and alternate embodiments are contemplated, and can be made without departing from the spirit and scope of the invention as defined in the appended claims.

I claim:

1. A method of compressing a digitized audio signal representing a sound, said signal having an audio bandwidth, in an audio compression system representing sound samples or spectral values using a scale-factor plus data format, wherein a sample is represented as a product of a scale factor and an associated quantity—the method comprising the steps of:

receiving a digital signal representing a sound;

organizing samples into at least one audio frame, said frame comprising a plurality of temporally sequential samples representing a time interval;

for each frame, processing said plurality of temporally sequential samples into a plurality of subband signals, each subband signal representative of a respective subband frequency range and comprising a time sequence of audio samples within said subband frequency range;

converting said subband signals into a format expressing each filtered audio sample as a product of a) a scale factor, represented in a scale factor field and b) a quantity, represented in a quantity field;

organizing in two dimensions the scale factor fields of said subband signals at least one tile corresponding to each frame said tile comprising a matrix of scale factors organized by time as a first dimension, and a subband frequency range as a second dimension;

processing said at least one tile with a two dimensional orthogonal transform to produce for each said tile a respective scale factor coefficient matrix (SCM);

compressing each said SCM to produce a compressed coefficient matrix representing the scale factors in a tile in a compressed format;

packing said compressed coefficient matrix in a data format for transmission.

2. The method of claim 1, wherein said orthogonal transform comprises a two dimensional, discrete cosine transform.

3. The method of claim 1, wherein said at least one tile comprises a plurality of tiles, said plurality of tiles derived by partition of a two-dimensional matrix representing a complete audio frame;

each said tile representing a sub-interval of time and a fraction of the frequency range of said complete audio frame.

4. The method of claim 3, further comprising the step of:

after said step of processing each of said tiles, requantizing said at least one tile in accordance with a requantization matrix.

5. The method of claim 1, wherein said step of compressing comprises:

for at least one SCM, rearranging coefficients into a string of coefficients.

6. The method of claim 5, wherein said step of compressing further comprises:

using an entropy reducing code to compress said string of coefficients.

7. The method of claim 6, wherein said entropy reducing code comprises a Huffman code.

8. The method of claim 1, wherein said compressing step includes using differential coding across related tiles in a common frame.

9. The method of claim 1, wherein said step of organizing the scale factor fields comprises modifying said at least one tile by a prediction model that models a matrix by a calculated trend across at least one of a) rows, and b) columns, to obtain a modified matrix of scale factors.

10. The method of claim 9, wherein said prediction model comprises a linear prediction model, and wherein said calculated trend is a linear trend.

11. The method of claim 9, wherein said prediction model comprises a polynomial model, and said calculated trend comprises a polynomial function.

12. The method of claim 1, wherein said step of processing said plurality of temporally sequential samples into a plurality of subband signals comprises:

filtering said temporally sequential samples with a bank of digital bandpass filters, then decimating to generate a plurality of critically sampled subband signals.

13. The method of claim 1, wherein said step of processing said plurality of temporally sequential samples into a plurality of subband signals comprises:

transforming sequential sets of said samples into a frequency domain representation by a frequency transform, to produce for each said set a series of subband signals corresponding to a set of frequency bins.

14. The method of claim 1, further comprising the step of transmitting said compressed coefficient matrix through a transmission medium.

15. The method of claim 14, wherein said transmission medium includes a data network.

16. The method of claim 1, further comprising the step of recording said compressed coefficient matrix on a machine readable medium.

17. A method of decoding an encoded electronic data signal representing an audio signal, useful in decoding a signal wherein samples are encoded by a system representing sound samples or spectral values using a scale-factor plus quantity format, wherein a sample is represented as a product of a scale factor and an associated quantity Q—the decoding method comprising the steps of:

decoding an input signal into data packets;

unpacking a received data packet to separate encoded scale factor data and encoded quantity data;

decompressing said encoded scale factor data to generate at least one coefficient matrix; and transforming said at least one matrix by a two dimensional inverse orthogonal transform, said inverse orthogonal transform the inverse of an orthogonal transform used to encode said coefficient matrices, to obtain at least one corresponding scale factor matrix.

18. The method of claim 17, wherein said inverse orthogonal transform comprises an inverse, two-dimensional discrete cosine transform.

19. The method of claim 17, wherein:

said at least one coefficient matrix comprises a plurality of coefficient matrices;

said step of transforming said at least one coefficient matrix comprises transforming each of a plurality of coefficient matrices to obtain a plurality of corresponding scale factor submatrices;

and further comprising the step of assembling said scale factor submatrices into a larger frame matrix, by concatenating said scale factor submatrices in a predetermined pattern of tiles corresponding to a tiling pattern used in a known encoder.

20. The method of claim 17, wherein said step of decompressing said encoded scale factor data comprises decoding an entropy reducing code.

21. The method of claim 20, wherein said entropy reducing code comprises a Huffman code.

22. The method of claim 21, wherein said step of decompressing said encoded scale factor data further comprises decoding differences between adjacent submatrices in a common frame matrix, and summing said differences to reconstruct submatrices.

23. The method of claim 21, further comprising the step of:

re-quantizing said scale factor matrix to obtain a decompressed, requantized scale factor matrix by converting said decompressed scale factors from a non-linear quantization to a linear scale factor, thereby calculating a scale factor matrix for an audio frame.

24. The method of claim 17, further comprising the steps of:

multiplying elements of said scale factor matrix by corresponding data quantities (Q) to reconstruct a matrix of audio samples.

25. The method of claim 17, wherein said input signal is received from a data network.

26. The method of claim 17, wherein said signal is read from a machine readable storage medium.

27. A method of decoding an encoded electronic data signal representing an audio signal, useful in decoding a signal wherein samples are encoded by a system representing sound samples or spectral values using a scale-factor plus quantity format, wherein a sample is represented as a product of a scale factor and an associated quantity Q—the decoding method comprising the steps of:

unpacking a received data packet to separate encoded scale factor data and encoded quantity data;

decompressing said encoded scale factor data to generate at least one coefficient matrix;

transforming said at least one matrix by a two dimensional inverse orthogonal transform, said inverse orthogonal transform the inverse of an orthogonal transform used to encode said coefficient matrices, to obtain at least one corresponding scale factor matrix.

multiplying elements of said scale factor matrix by corresponding data quantities (Q) to reconstruct a matrix of audio samples; and processing said matrix of audio samples to construct a stream of sequential, digitized audio samples.

28. The method of claim 27, wherein said step of processing said matrix of audio samples comprises:

for each row of said matrix of audio samples, processing the row with a synthesizing filter, said synthesizing filter up-sampling the row to a frame length in samples, in a manner complementary to a decimation performed in a known encoder, thereby obtaining a plurality of reconstructed subband signals mixing said reconstructed subband signal to produce a replica of a full band audio signal representing a sound.

29. The method of claim 28, further comprising the step of outputting said audio samples to another device for purposes of reproducing a sound.

30. The method of claim 28, further comprising the step of causing a sound to be reproduced, based upon said stream of sequential digitized audio samples, said sound an approximate replica of a sound encoded by a method compatible with the method of decoding.

* * * * *